US007093355B2

(12) United States Patent
Gerth

(10) Patent No.: US 7,093,355 B2
(45) Date of Patent: Aug. 22, 2006

(54) METHOD AND DEVICE FOR PRODUCING FLAT METAL RIBBON CABLES

(75) Inventor: Volker Gerth, Schieder (DE)

(73) Assignee: Karl Fuhr GmbH & Co. KG Maschinenfabrik, Horn-Bad Memberg (DE)

( * ) Notice: Subject to any disclaimer, the term of this patent is extended or adjusted under 35 U.S.C. 154(b) by 0 days.

(21) Appl. No.: 10/490,789

(22) PCT Filed: Sep. 20, 2002

(86) PCT No.: PCT/DE02/03524

§ 371 (c)(1),
(2), (4) Date: Mar. 25, 2004

(87) PCT Pub. No.: WO03/028041

PCT Pub. Date: Apr. 3, 2003

(65) Prior Publication Data

US 2004/0237300 A1 Dec. 2, 2004

(30) Foreign Application Priority Data

Sep. 25, 2001 (DE) ..... 101 47 022
Oct. 25, 2001 (DE) ..... 101 52 054
Oct. 25, 2001 (DE) ..... 201 17 301 U

(51) Int. Cl.
*H01R 43/00* (2006.01)
*B23P 19/00* (2006.01)

(52) U.S. Cl. ..... 29/825; 29/745; 72/199; 72/200; 72/201; 156/47; 156/50

(58) Field of Classification Search ..... 29/825, 29/745; 72/199, 200; 156/47, 50
See application file for complete search history.

(56) References Cited

U.S. PATENT DOCUMENTS 3,286,617 A * 11/1966 Shirk ..... 454/165
3,312,773 A * 4/1967 Lit ..... 174/119 R
4,549,420 A 10/1985 Cloostermans-Huwaert
5,744,756 A * 4/1998 Springer et al. ..... 174/110 N
5,784,914 A * 7/1998 Ciani ..... 72/205
5,794,473 A 8/1998 Palzer
6,026,563 A * 2/2000 Schilson ..... 29/825

FOREIGN PATENT DOCUMENTS

DE 30 39 237 11/1982
DE 24 02 574 3/1989
DE 38 43 730 6/1990
DE 196 25 811 2/1997
DE 101 52 054 7/2003
GB 2 197 233 5/1988

OTHER PUBLICATIONS

Nonferrous Wire Handbook, vol. 3: Principles and Practice (1995) by The Wire Associates International, Inc., pp. 238–241.

* cited by examiner

*Primary Examiner*—Carl J. Arbes
(74) *Attorney, Agent, or Firm*—Cohen, Pontani, Lieberman & Pavane

(57) ABSTRACT

A round wire is cold formed in a first pair of forming rolls to produce a flat metal ribbon cable having a specified width, followed by cold forming the flat metal ribbon cable in a second pair of forming rolls to produce a flat metal ribbon cable having a specified thickness and said specified width without any additional edge processing.

22 Claims, 2 Drawing Sheets

METHOD AND DEVICE FOR PRODUCING FLAT METAL RIBBON CABLES

PRIORITY CLAIM

This is a U.S. national stage of application No. PCT/DE02/03524, filed on 20 Sep. 2002. Priority under 35 U.S.C. §119(a) and 35 U.S.C. §365(b) is claimed from German Application No.: 101 47 022.3, filed 25 Sep. 2001; German Application No.: 101 52 054.9, filed 25 Oct. 2001; and German Application No: 201 17 301.8, filed 25 Oct. 2001.

BACKGROUND OF THE INVENTION

1. Field of the Invention

The invention pertains to a cold forming by cold rolling process for the production of flat metal ribbon cables.

2. Description of the Related Art

Flat metal ribbon cables, especially of copper or copper alloys, are preferred today as electrical conductors in, for example, the motor vehicle industry, because these flat ribbon cables offer the advantage of better custom manufacturing. Because of their larger surface areas, heat can be also be dissipated more effectively from their surfaces, which means that they can also be subjected to greater electrical loads than a round wire can.

In the production of this type of flat ribbon cable by cold forming with rolls, a round wire is used as the blank, which is usually passed through a multi-stand section of shaped rolls, usually with 4 or more pairs of rolls, to flatten the wire to its final thickness. It is typical in this case that, after every pass, i.e., each time the wire passes through a pair of rolls, the material then passes through another pair of rolls to work the edges, the axes of rotation of this additional pair being perpendicular to those of first pair. This second pass usually occurs in a "closed" manner; that is, the edges of the wire are gripped by a grooved roll. It is also sometimes done simply in an "open" manner, for which a pair of cylindrical rolls is used. It both cases, the dimensions of the blank are adjusted appropriately so that it can be subjected to further processing.

After it has passed through the shaped roll section, the flat ribbon cable is then wound up on a spool or the like and is then available for final processing.

The shaped roll sections in question are mechanical installations which are complicated in design and require sophisticated engineering. They are therefore quite expensive.

SUMMARY OF THE INVENTION

Against this background, the task of the invention is to make available a process and installation which offer the possibility of producing dimensionally accurate flat ribbon cables at comparatively low cost on devices which are significantly simpler than the known rolling systems for flat wire.

This technical problem is solved by the process and installation according to the invention, where, in a process for the production of metal flat ribbon cables by cold forming with rolls, a round wire is rolled to a predetermined width in a first pass and then to a predetermined thickness in a following pass, without any additional processing of the edges.

There is therefore no need for any processing of the edges at all during the cold-forming process. In addition, the cold forming is accomplished in only two passes. A two-stand rolling section is therefore sufficient for the process according to the invention. Preferably, a two-stand forming arrangement is provided with two pairs of rolls in immediate succession, the axes of rotation of which are aligned in the same direction.

The surprising discovery was made that, if the amount of deformation is large enough, the width of a flat ribbon cable can be largely determined by the first pass.

The flat ribbon cable is then essentially rolled to the exact specified thickness in the second pass.

No edge processing, especially no rolling of the edges, in either an open or a closed manner, is necessary. If desired, depending on the material which has been worked, the edges can be deburred, and the flat ribbon cable can also be straightened.

It been found to be effective in the process according to the invention for the round wire to be stretched and/or drawn before the first pass. As a result, internal stresses, for example, are removed from the wire, and the wire blank also becomes easier to work with because there is no longer any twist to be dealt with.

The wire is preferably drawn through a wire die before the first pass, so that the surface of the wire can be mechanically cleaned and smoothed and so that the wire is freed as completely as possible of external contamination. This measure also ensures that the diameter of the wire is calibrated with precision.

By means of this measure, it is also possible in particular to reduce the cross-sectional surface area of the wire by 5–35% before the first pass. For example, a wire with a diameter of 3.4 mm can be reduced to a diameter of 2.8 mm before it undergoes the first pass.

The stresses which develop in the flat ribbon cable as a result of cold forming are preferably eliminated by annealing after a pass. Even more preferably, they are eliminated by annealing after the second pass.

It is advantageous for all of the work steps to be carried out in-line within the installation, that is, one immediately after the other, in the same production line.

It has also been found to be advisable in a process according to the invention for a controlled system to be used to adjust the distance between the rolls during the first pass to determine the width of the flat ribbon cable. For this purpose, a measurement section is provided immediately downline from the first pair of rolls, even more preferably downline from the second pair of rolls, where the dimensions of the flat ribbon cable, especially its width, can be detected by a measuring station. By means of this controlled system, deviations which occur between the actual and the nominal dimensions can be corrected by adjustment of the gap between rolls of the first pair.

The second pair of rolls serves essentially to adjust the thickness of the flat ribbon cable to a precise value. For this purpose, too, it is advisable to provide a controlled system to adjust the roll gap for the second pass to arrive at the desired thickness of the flat ribbon cable. Thus flat ribbon cables are produced with an extremely uniform thickness, with an allowable variation in thickness of only ±1/500mm and an allowable variation in width of only ±0.03 mm.

It is important in the process according to the invention for the ratio of the diameter of the wire to the thickness of the flat ribbon cable after the first pass to be between 5 and 10, especially about 7. As a result, a round wire with a diameter of, for example, 2.8 mm is deformed into a flat ribbon cable with a thickness of 0.4 mm in the first pass. In contrast, the ratio of the thickness of the ribbon cable after the first pass to the thickness of the ribbon cable after the second pass is between 1.5 and 3, especially about 2. This ratio is therefore much smaller, which means that what the second pass does is really only to adjust the thickness of the cable to the exact desired value.

The flat ribbon cable obtained by cold forming with rolls according to the invention preferably has a thickness-to-width ratio after the second pass of 1:30 to 1:65.

It is an advantage of the process according to the invention that the processing speed can be increased considerably in comparison to conventional rolling systems; in particular, the processing speed can be more than 450 m/min, preferably about 500 m/min. In contrast, conventional high-speed rolling installations normally achieve speeds of only about 400 m/min.

The high processing speed can be explained at least in part by the inventive measure that processing occurs in-line. In addition, an extremely compact installation for implementing the process is also made available in this way.

In an installation of this type for the production of a flat ribbon cable by cold rolling, especially in an installation designed to implement the previously explained process comprising pairs of rolls between which a wire is cold-formed, a two-stand forming installation is provided with two immediately successive pairs of rolls with similarly oriented axes of rotation. Thus the cold forming occurs exclusively in one direction, and there is no longer any need for a separate step to process the edges; in particular, there is no longer any need to pass the cable through an additional pair of rolls with axes perpendicular to those of the first pair of rolls.

In-line with and upstream of the first pair of rolls, the installation according to the invention has a stretching and/or drawing device for the round wire to be worked. In particular, a compact design can also be achieved by combining these two devices directly with each other.

The same thing also applies when an annealing device for the flat ribbon cable is installed downstream of and in-line with a pair of rolls, especially the second pair. If desired, an annealing device can also be provided downline from the first pair of rolls in cases where, for example, the ductility of the material of the flat ribbon cable has been reduced to such an extent by the first pass that a limit is imposed on further processing.

In the installation according to the invention, a flat ribbon cable measuring station is also provided to detect the size of the ribbon cable, and a controlled system is provided to adjust the gap between the rolls of the first roll pair to produce a flat ribbon cable of the specified width. This flat ribbon cable measuring station can be installed directly downline from the first pair of rolls, but it is preferably installed downline from the second pair. The latter variant offers the advantage that a specified nominal dimension of the flat ribbon cable can be determined directly, so that the roll gaps can be adjusted immediately for rolling to the nominal dimension.

The roll gap of the second pair of rolls is also adjusted with precision, for which purpose a flat ribbon cable measuring station especially for measuring the thickness of the flat ribbon cable is provided. By means of a controlled system, this measuring station makes it possible for the roll gap of the second pair of rolls to be adjusted in such a way that a flat ribbon cable of the specified thickness is produced. This measuring station can be combined with the measuring station used for the adjustment of the first pair of rolls; that is, both of them can be installed behind the second pair of rolls, as a result of which it is possible to maintain the nominal dimensions to within an allowable limit of ±0.002 mm with respect to thickness and to within an allowable limit of ±0.03 mm with respect to width.

In an embodiment of the installation according to the invention, it is provided that the processing speed of the installation is determined by the drive unit which drives the rolls of the second pair. The surprising discovery was made that it is not the first pair of rolls, which performs the larger amount of deformation work, but rather the second pair of rolls which determines the processing speed. This measure is also associated with the previously explained automatic control of the roll gaps and ensures a dimensionally accurate end product.

Because the second roll drive unit determines the processing speed of the installation, it has also been found effective to assign a dancer to the drawing device, to a pair of rolls, and/or to the annealing device. The idea here in particular is that each processing station with a forward drive mechanism is provided with a dancer, which is installed preferably between the mechanism in question and the drive which determines the processing speed of the installation, here in particular the roll drive unit of the second roll pair. As a result of this measure, it is possible not only to synchronize the speeds by the automatic adjustment of the dancers but also to adjust the tension to the desired value.

DETAILED DESCRIPTION OF THE PRESENTLY PREFERRED EMBODIMENTS

Figure 1:
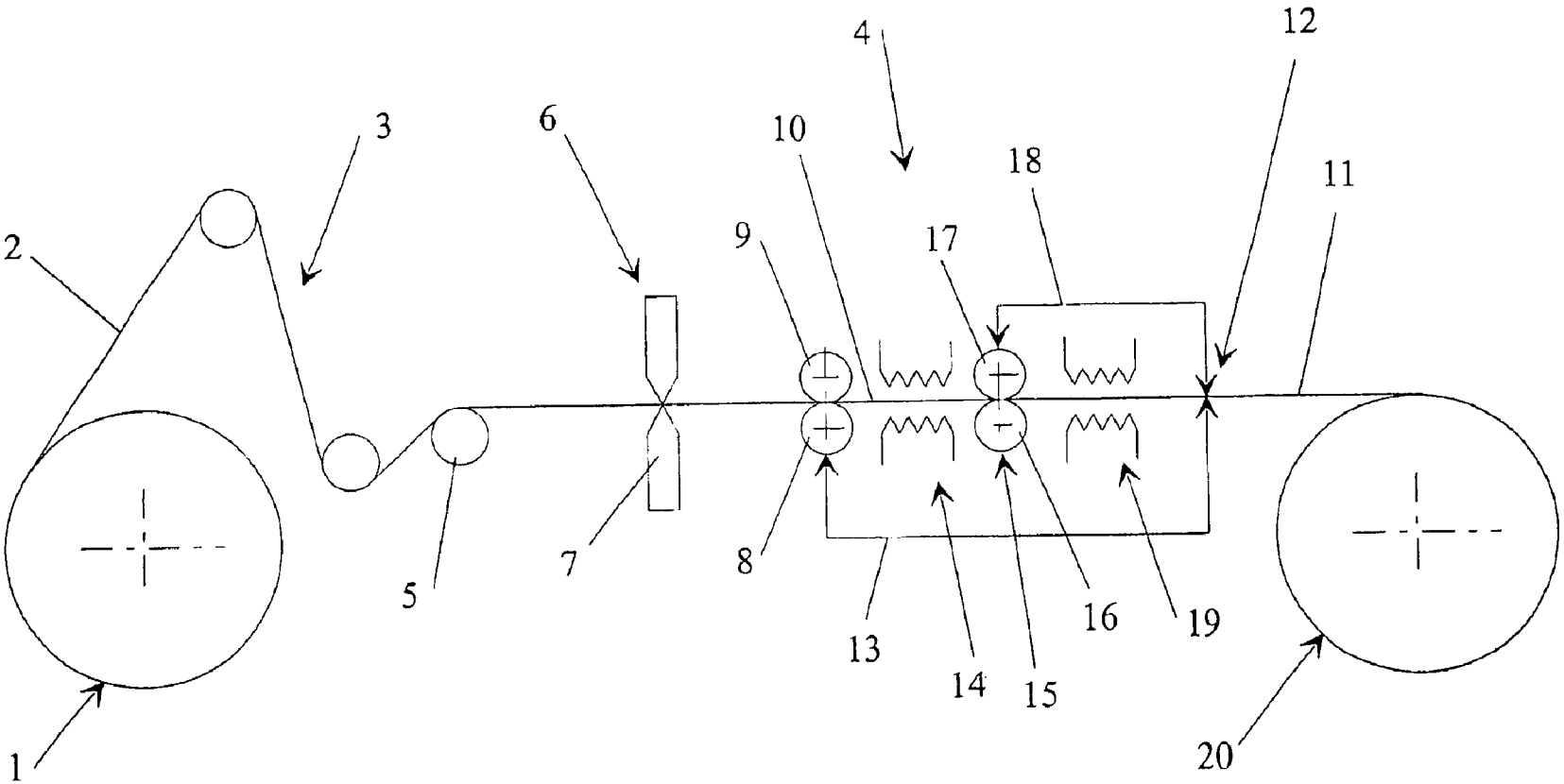
FIG. 1 shows a first exemplary embodiment of an installation according to the invention.

The left half of FIG. 1 shows a reel 1, from which a round wire is pulled in the standard way and sent to, for example, an intermediate storage location, i.e., a dancer 3, or the like, so that a device 4 for the cold forming of the round wire 2 can be reliably supplied in a continuous manner.

The round wire 2 is supplied first by way of, for example, a deflecting roll 5 from the dancer 3 to a stretching and/or drawing device 6, which is merely indicated here by a wire die 7. The process of drawing the wire 2 through the wire die 7 has the effect of mechanically cleaning the surface of the round wire 2 of impurities, burrs, and the like; and the diameter of the wire is also adjusted to an exact value. In regard to this diameter, the goal is to reduce the cross-sectional surface of the wire by up to 35%; for example, the diameter can be reduced from 3.4 mm to 2.8 mm.

A first pass is accomplished between the two rolls 8, 9 of the first pair, as a result of which a flat ribbon cable 10 is obtained, which has a width which is already very close to the final dimension. The accomplishment of this goal is also facilitated by ensuring that the ratio of the diameter of the round wire 2 to the thickness of the flat ribbon cable 10 after the first pass is between 5 and 10, and preferably about 7.

Immediately after the first pass or, as presented here, preferably after passing through the entire cold-forming section, the finished flat ribbon cable 11 can be measured by a flat ribbon cable measuring station 12. If there are deviations between the actual and the specified nominal value, the distance between the rolls 8, 9 can thus be adjusted by way of a controlled system 13 until the width of the ribbon cable 11 corresponds exactly to the specified nominal value.

An annealing device 14 can be provided, if desired, after the first pair of rolls 8, 9, but it is preferable and also sufficient for the flat ribbon cable 10 to be sent directly after the first pass, without any further processing, to the second pair 15 of rolls, the rolls 16, 17 of which have axes with the same orientation as those of the first pair. The gap between the rolls 16, 17 of the roll pair 15 then essentially determines only the thickness of the flat ribbon cable 11.

This gap, too, can be adjusted by way of a controlled system 18, in the event that the flat ribbon cable measuring station 12 detects deviations between the actual thickness of the ribbon cable and the specified nominal value.

After the cold-forming process, the flat ribbon cable 11 preferably passes through an annealing station 19, so that internal stresses, brittleness, and the like can be removed from the flat ribbon cable 11, and so that the cable can then be wound up on a reel 20, for example, and made available in this form as a finished, elastic and stretchable end product.

Figure 2:
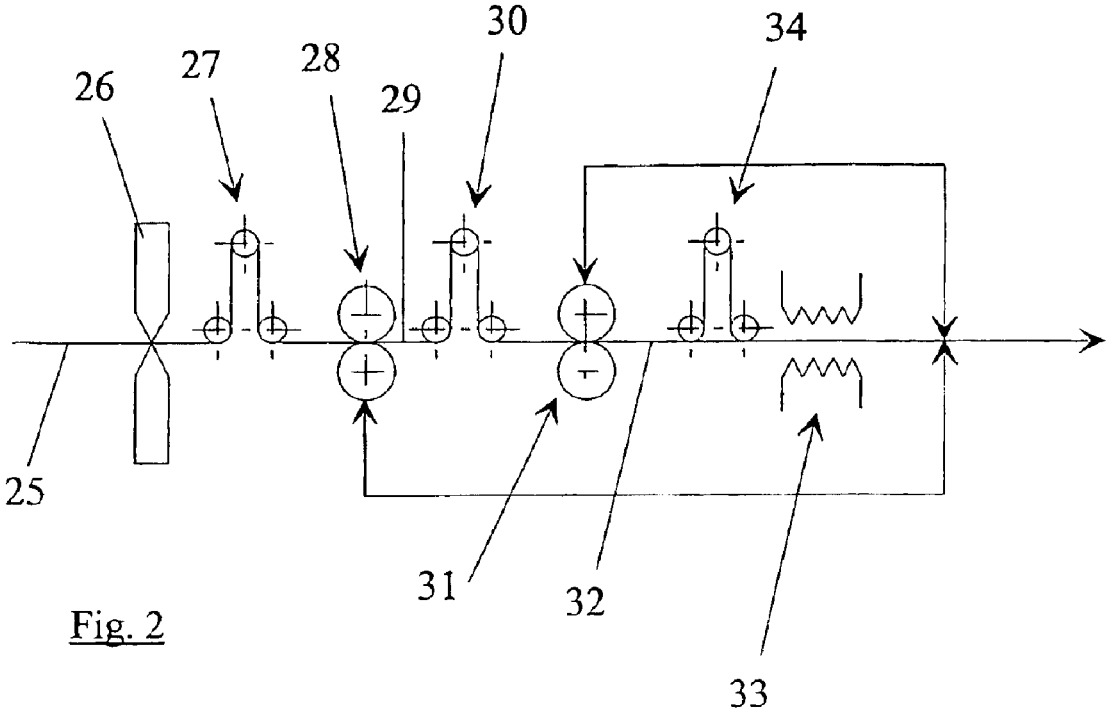
FIG. 2 shows a second exemplary embodiment.

Another exemplary embodiment of the installation according to the invention is explained in greater detail on the basis of FIG. 2.

From a reel and a storage unit such as a dancer or the like, a round wire 25 is pulled through the wire die 26 (indicated schematically), the cross-sectional surface being reduced by as much as 35% from a diameter of, for example, 3.4 mm to a diameter of 2.8 mm. A wire with an exactly calibrated diameter and with a clean surface is then available for further processing. Immediately following the drawing device, a dancer 27 is installed, through which the round wire travels before arriving at the first pair of rolls 28.

The ribbon cable 29 obtained after the first pass has a width which already corresponds essentially to the exact desired value. The cable then proceeds to the dancer 30 assigned to the roll pair 28, and then, in the second pass, the cable is brought to the exact thickness desired between the rolls of the second roll pair 31.

In this exemplary embodiment, the drive unit for the second roll pair is the unit which determines the processing speed of the installation. When this measure is implemented, it is advisable for the dancers 27, 30 assigned to the drawing device 26 and to the first roll pair 28 to be installed between the drawing device 26 and the drive which determines the processing speed, here the drive unit of the roll pair 31.

No provisions are made between the two roll pairs 28, 31 for any additional processing. Instead, the cable is transferred directly from the one pair of rolls 28 to the other pair 31 via the dancer.

The flat ribbon cable 32 obtained after the second pass is sent to an annealing station 33 by way of another one of these assigned dancers 34; after the annealing station 33, the ribbon cable leaves the installation according to the invention as a finished product. If additional processing stations are also set up after the second pair of rolls, especially stations with their own forward drives for the ribbon cable, a dancer is also advisably assigned to each of these. The dancers located downstream of the speed-determining drive of the second roll pair 31 are preferably installed upstream of the processing station in question.

Through the use of the dancers 27, 30, 34, the other processing stations can also be synchronized automatically with the processing speed, which is determined by the processing speed of the drive device of the second pair of rolls 31. The tension can also be adjusted precisely.

What is claimed is:

1. A process for the production of metal ribbon cable comprising:

cold forming a round wire in a first pair of forming rolls to produce a flat metal ribbon cable having a specified width; wherein said first pair of rolls are separated by a gap which determines the width of said ribbon cable;

cold forming said flat metal ribbon cable in a second pair of forming rolls to produce a flat metal ribbon cable having a specified thickness and substantially said specified width without any additional edge processing;

measuring the width of said ribbon cable following forming in said second pair of rolls; and adjusting the gap of the first pair in accordance with the measured width in order to obtain a desired width.

2. A process as in claim 1 further comprising reducing the diameter of said round wire prior to forming said wire in said first pair of forming rolls.

3. A process as in claim 2 wherein the diameter of said round wire is reduced by drawing the wire through a wire die.

4. A process as in claim 2 wherein the diameter of said round wire is reduced so that the cross-sectional area of the wire is reduced by 5–35%.

5. A process as in claim 1 further comprising annealing said flat metal ribbon cable after forming in said first pair of forming rolls.

6. A process as in claim 1 further comprising annealing said flat metal ribbon after forming in said second pair of forming rolls.

7. A process as in claim 1 wherein said second pair of rolls are separated by a gap which determines the thickness of said ribbon cable, said process further comprising:

measuring the thickness of said ribbon cable following forming in said second pair of rolls, and adjusting the gap of the second pair in accordance with the measured thickness in order to obtain a desired thickness.

8. A process as in claim 1 wherein the ratio of the diameter of the round wire to the thickness of the flat ribbon cable after forming in the first pair of rolls is between 5 and 10.

9. A process as in claim 1 wherein the ratio of the thickness of the flat ribbon cable after forming in the first pair of rolls to the thickness of the flat ribbon cable after forming in the second pair of rolls is between 1.5 and 3.

10. A process as in claim 1 wherein, after forming in the second pair of rolls, the ratio of the thickness of the ribbon cable to its width is between 1:30 and 1:65.

11. A process as in claim 1 wherein the flat metal ribbon cable emerges from the second pair of rolls at a speed of at least 450 m/min.

12. A process as in claim 1 wherein said process is an in-line process.

13. An apparatus for the production of flat metal ribbon cable by cold rolling, said apparatus comprising:

a first pair of forming rolls for cold forming a round wire to produce a flat metal ribbon cable having a specified width;

a second pair of forming rolls for forming said flat metal ribbon cable to produce a flat metal ribbon cable having a specified thickness and substantially said specified width, said second pair of forming rolls having axes of rotation which are parallel to the axes of rotation of the first pair of forming rolls; and a drawing device for reducing the diameter of said round wire upstream of and in-line with said first pair of forming rolls.

14. An apparatus as in claim 13 further comprising an annealing device downstream from and in-line with said second pair of forming rolls.

15. An apparatus as in claim 13 further comprising:

a measuring station downstream of said second pair of rolls for measuring the width of said flat metal ribbon cable; and means for adjusting a gap between the first pair of rolls in accordance with the measured width in order to obtain a desired width.

16. An apparatus as in claim 13 further comprising:

a measuring station downstream of said second pair of rolls for measuring the thickness of said flat metal ribbon cable; and means for adjusting a gap between the second pair of rolls in accordance with the measured thickness in order to obtain a desired thickness.

17. An apparatus as in claim 13 further comprising a roll drive unit for said second pair of rolls, said roll drive unit determining the roll drive speed of the installation.

18. An apparatus as in claim 13 further comprising a dancer downstream of a respective at least one of said roll pairs.

19. A process for the production of metal ribbon cable comprising:

cold forming a round wire in a first pair of forming rolls to produce a flat metal ribbon cable having a specified width, wherein the ratio of the diameter of the round wire to the thickness of the flat ribbon cable after forming in the first pair of rolls is between 5 and 10; and cold forming said flat metal ribbon cable in a second pair of forming rolls to produce a flat metal ribbon cable having a specified thickness and substantially said specified width without any additional edge processing.

20. A process as in claim 19 further comprising reducing the diameter of said round wire by drawing the wire through a wire die prior to forming said wire in said first pair of forming rolls.

21. A process as in claim 19 wherein the ratio of the thickness of the flat ribbon cable after forming in the first pair of rolls to the thickness of the flat ribbon cable after forming in the second pair of rolls is between 1.5 and 3.

22. A process as in claim 19 wherein, after forming in the second pair of rolls, the ratio of the thickness of the ribbon cable to its width is between 1:30 and 1:65.

* * * * *